US007632220B2

(12) United States Patent
Nelson et al.

(10) Patent No.: US 7,632,220 B2
(45) Date of Patent: Dec. 15, 2009

(54) EXERCISE APPARATUS

(75) Inventors: Derek Nelson, Lake Mills, WI (US); Hung-Mao Liao, Taya Hsiang (TW); Te-Chang Huang, Taya Hsiang (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 0 days.

(21) Appl. No.: 12/454,762

(22) Filed: May 26, 2009

(65) Prior Publication Data

US 2009/0239715 A1 Sep. 24, 2009

Related U.S. Application Data

(63) Continuation-in-part of application No. 12/321,294, filed on Jan. 21, 2009, which is a continuation of application No. 11/497,139, filed on Aug. 2, 2006, now Pat. No. 7,530,930.

(51) Int. Cl.
*A63B 69/16* (2006.01)

(52) U.S. Cl. ..... 482/57; 482/52; 482/70

(58) Field of Classification Search ..... 482/51–53, 482/57–65, 70, 71, 79, 80
See application file for complete search history.

(56) References Cited

U.S. PATENT DOCUMENTS 5,813,949 A 9/1998 Rodgers, Jr.
6,007,462 A 12/1999 Chen
6,390,953 B1 * 5/2002 Maresh et al. ..... 482/52
6,390,954 B1 5/2002 Lee
6,450,925 B1 * 9/2002 Kuo ..... 482/52
6,672,992 B1 1/2004 Lo
6,689,019 B2 * 2/2004 Ohrt et al. ..... 482/57
6,719,666 B1 4/2004 Lo
6,994,656 B2 2/2006 Liao et al.

FOREIGN PATENT DOCUMENTS

CN 1202836 A 12/1998

* cited by examiner

*Primary Examiner*—Glenn Richman

(57) ABSTRACT

An exercise apparatus is disclosed herein, including a frame, a rotating assembly, two supporting rods, two swing arms, two links, and two pedals. The front ends of the supporting rods are connected respectively to two pivotal ends of the rotating assembly, and the rear end of each supporting rods moves back and forth along a corresponding track. The front ends of the links are connected respectively at two swing ends of the swing arms. Each pedal has a step surface and is coupled to the rear portion of the corresponding link. The distance between the bottom of a circular path of the pivotal ends and the tracks is smaller than 10 cm. The length of the supporting rod is smaller than two times diameter of the circular path. The longitudinal horizontal distance between the front edge of the closed path and the rear edge of the circular path is smaller than 20 cm. The rear ends of the supporting rods are located between the front ends and rear ends of the pedals. In an embodiment, a highest point of the step surface of the pedal has a step height relative to the track and the step height is less than 20 cm.

7 Claims, 11 Drawing Sheets

EXERCISE APPARATUS

CROSS-REFERENCE TO RELATED APPLICATION

This is a continuation-in-part of U.S. patent application Ser. No. 12/321,294, filed on Jan. 21, 2009 which is a continuation application of U.S. patent application Ser. No. 11/497,139, filed on Aug. 2, 2006 now U.S. Pat. No. 7,530,930.

BACKGROUND

1. Field of the Invention

This invention relates to an exercise apparatus and, more particularly to an elliptical exercise apparatus with small size for reducing space occupation and low step height for easy access.

2. Description of the Related Art

Elliptical exercise apparatus has been popular in recent years. Generally, elliptical exercise apparatus can guide left and right pedals to move along an elliptical path for simulating walking and running.

For example, an elliptical exercise apparatus is disclosed in U.S. Pat. No. 6,390,954. The elliptical exercise apparatus comprises a crank mounted at the front end of the frame; left and right tracks mounted at the rear end of the frame; left and right supporting rods mounted on left and right sides respectively; and left and right swing arms mounted at the front end of the frame. The front end of each supporting rod pivotally connects to a crank arm, so that the front ends can move along a circular path. The left and right supporting rods each has a roller mounted pivotally on the rear end, and the rollers move back and forth on the tracks. Two pedals are mounted respectively to the upper surfaces of the middle sections of supporting rods. Each swing arm has a top end for forming a handle, and a lower end connects to the corresponding supporting rod via a link. The left and right pedals move along a substantial elliptical closed path, and the left and right handles move back and forth correspondingly with the pedals.

The aforesaid elliptical exercise apparatus suffers from some shortcomings. First, the motion path of the pedals needs an adequate longitudinal length for exercising a user's legs, and the tracks at the rear end of the frame are longer than the longitudinal length of the motion path of the pedals, so the longitudinal length of the elliptical exercise apparatus is so long that it needs more space to be placed. Second, because the pedals are fixed securely on the supporting rods, the angle of the pedals varies with the motion path of the supporting rods. During operation period, the movement status of the user's feet does not conform to the actual movement status. Preferably, the upper surface of each pedal is substantially horizontal or slightly inclined forward when the pedal is at the bottom of the path. When the pedal is in the other segments, the front end of the pedal should be significantly lower than the rear of the pedal, especially when the pedal is at the top of the path. However, the user is not easier to access the prior elliptical exercise apparatus which has both features of preferably pedal and adequate longitudinal length. Because the features of longer longitudinal length and inclined forward posture result in a higher step height relative to the track at the rear end of the upper surface of the pedal when the pedal is at the bottom of the path. The higher step height hinders the user to step on the pedal because he has to lift his leg higher than usual.

U.S. Pat. No. 6,007,462 shows a small elliptical exercise apparatus which includes a frame; a crank mounted at the rear end of the frame; left and right swing arms mounted pivotally at the front end of the frame; and left and right supporting rods connected respectively to the lower ends of the swing arms and corresponding crank arm. Two pedals are mounted on the supporting rods respectively. Thereby the left and right pedals move along a substantial elliptical closed path. The longitudinal length of the elliptical exercise apparatus is small enough to be placed in a limited space. However, the pedal motion doesn't conform to ergonomics. When each pedal moves to the bottom of the elliptical path, the front end of the pedal is higher than the rear end of the pedal.

SUMMARY

In a preferred embodiment of the present invention, the elliptical exercise apparatus comprises: a frame adapted to rest on a surface, the frame including a front end, a rear end, a front region, and a rear region, the rear region having two tracks extending longitudinally; a rotating assembly having a pair of crank arms mounted on the front region of the frame, the pair of crank arms having two opposite pivotal ends moving along a circular path, and the distance between the bottom of the circular path and the tracks is smaller than 10 cm; a flywheel pivotally mounted on the front region of the frame and connected to the rotating assembly; left and right supporting rods, each of the left and right supporting rods having a front end, a rear end, and a supporting member therebetween, the respective distances between the front ends and the corresponding rear ends of the supporting rods being longer than the diameter of the circular path and smaller than two times diameter of the circular path, the supporting member located between the rear end and the middle of the supporting rod, the front ends of the left and right supporting rods pivotally connected to the pivotal ends of the pair of crank arms respectively, each of the rear ends of the left and right supporting rods moving along the corresponding track between a front point and a rear point so as to cause the corresponding supporting member to move along an arcuate closed path, therefore, in the longitudinal direction, the front edge of the closed path aligning transversely or being in back of the rear edge of the circular path, and the longitudinal horizontal distance between the front edge of the closed path and the rear edge of the circular path being smaller than 20 cm; left and right swing arms each having a pivot point connected to the front region of the frame, and a swing end located below the pivot point for moving back and forth; left and right links each having a front end and a rear end, the front ends respectively pivotally connected to the corresponding swing ends of the swing arms; and left and right pedals connected respectively to the rear portions of the left and right links and located behind the corresponding supporting members of the supporting rods, the left and right pedals further connected pivotally to the supporting members; wherein in the longitudinal direction, the front point of the track aligns transversely or is in back of the front edge of the motion path of the front ends of the pedals, and the rear point of the track aligns transversely or is in front of the rear edge of the motion path of the rear ends of the pedals.

In the other embodiment, left and right pedals are respectively alongside coupled to the rear portions of the left and right links. Each of the left and right pedals has a step surface. The step surface is lower than the top surface of the corresponding rear portion of the link.

Several objects and advantages of the present invention are: (a) to provide an elliptical exercise apparatus with an adequate path for the travel by a user's feet; (b) to provide an elliptical exercise apparatus with an ergonomic pedal motion;

(c) to provide an elliptical exercise apparatus with a shorter longitudinal length; and (d) to provide an elliptical exercise apparatus allowing a user easy to access.

DETAIL DESCRIPTION

Figure 1:
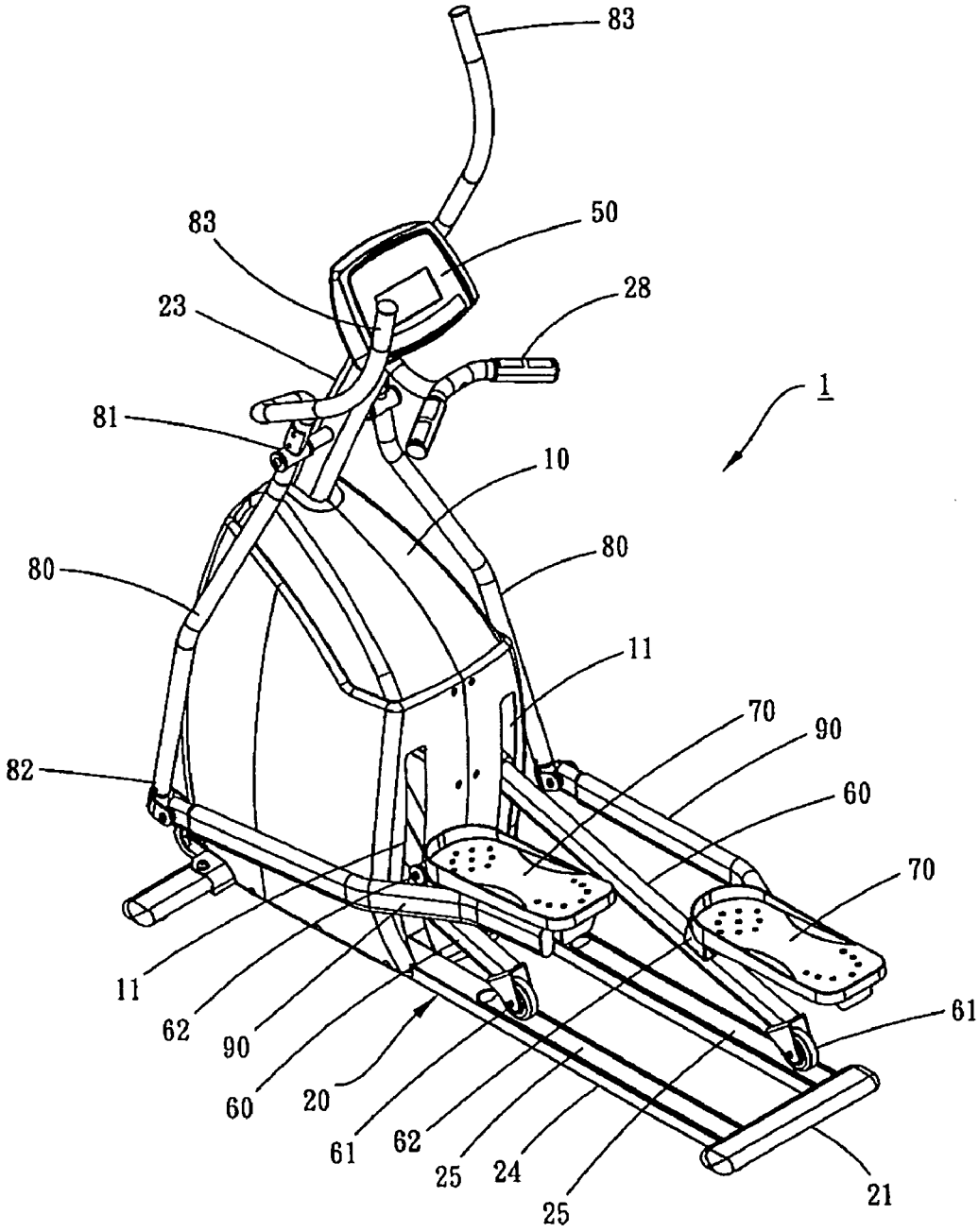
FIG. 1 is a perspective view of a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

A preferred embodiment elliptical exercise apparatus constructed according to the present invention is designated 1 in FIGS. 1-6, wherein FIGS. 3-6 illustrate the elliptical exercise apparatus 1 without a shroud 10.

Figure 2:
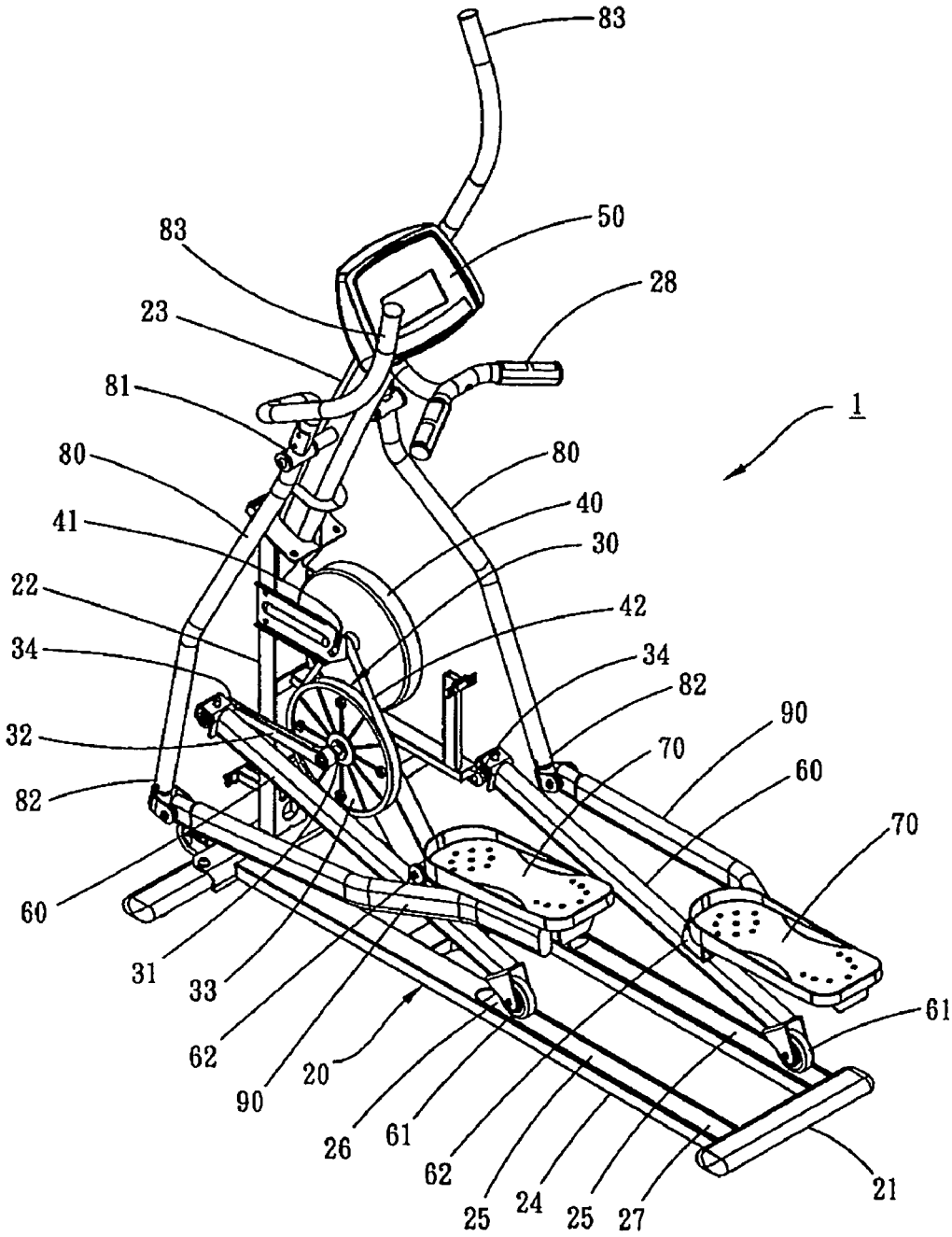
FIG. 2 is a perspective view of the preferred embodiment of FIG. 1 without the shroud.
Figure 3:
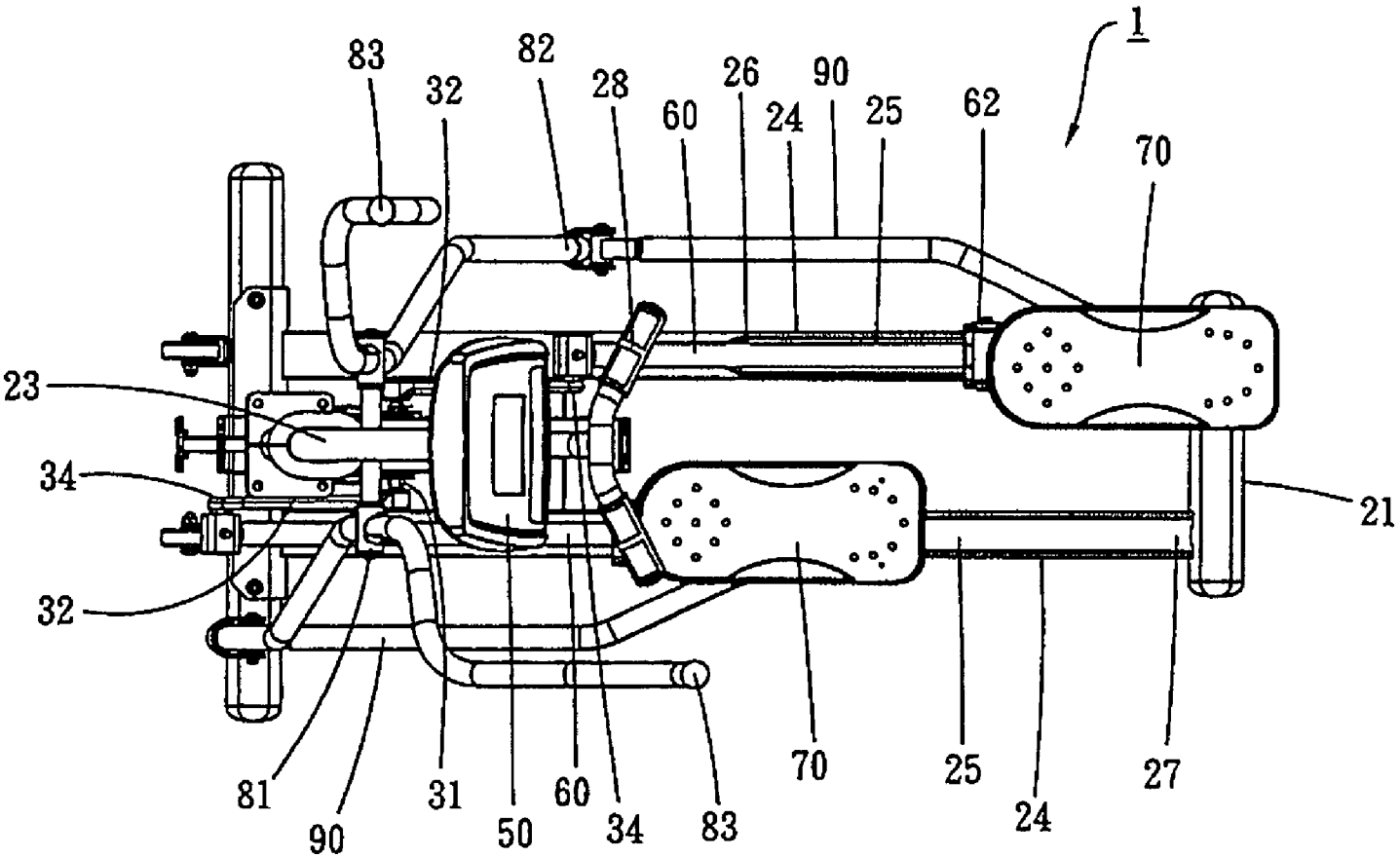
FIG. 3 is a top plan view of the preferred embodiment of FIG. 1 without the shroud.
Figure 5:
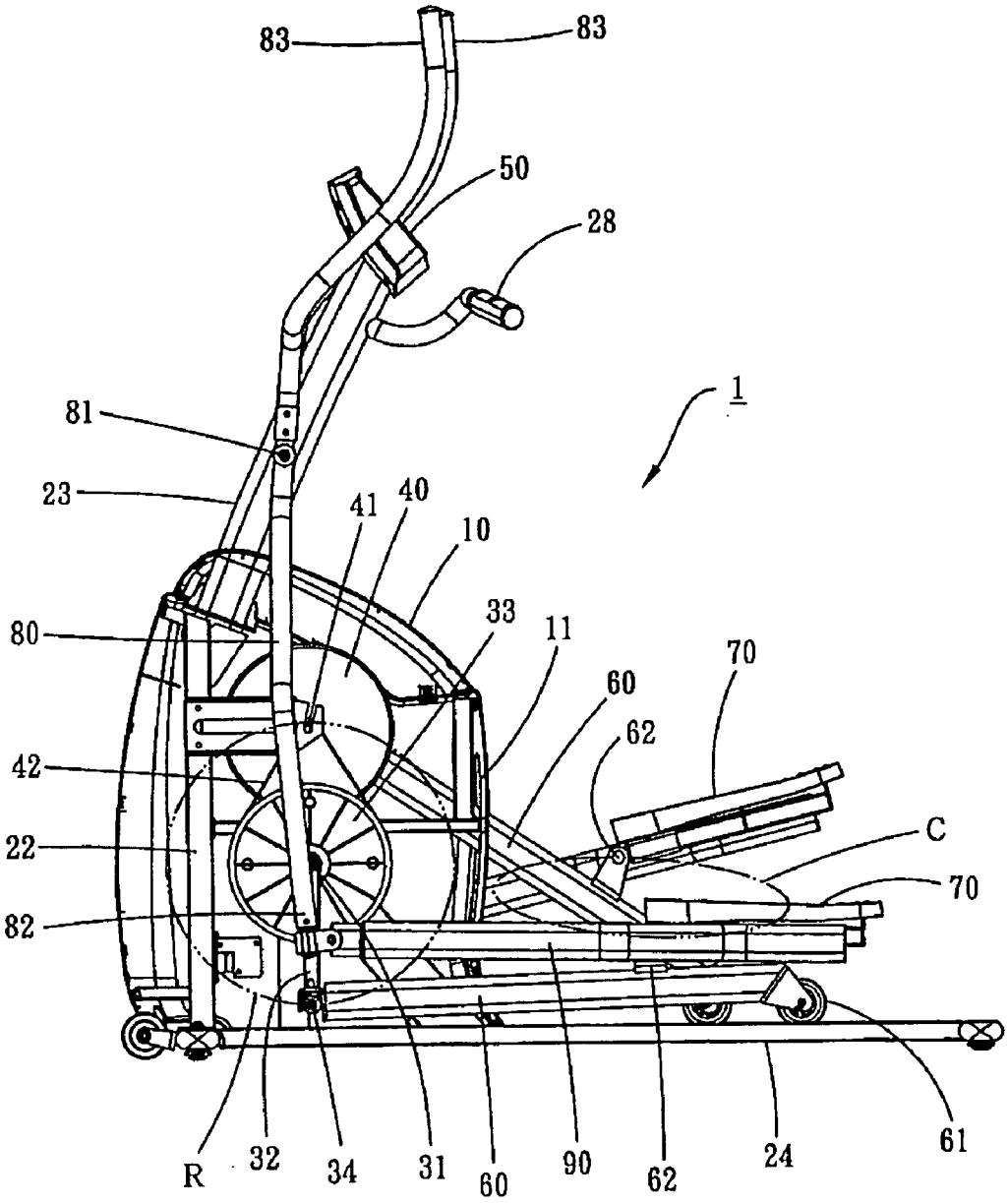
FIG. 5 is a left side view of the preferred embodiment of FIG. 4, and the two pedals respectively are at a higher end and a lower end in the movement area.

Now referring to FIG. 2, the elliptical exercise apparatus 1 comprises a frame 20 which is composed of a base 21 resting on a ground surface, a frame support 22 mounted at a front end of the base 21, and a console mast 23 extending upwardly from the frame support 22. The base 21 of the frame 20 includes two rails 24 extending forwardly from the rear end of the frame. The top of the rear section of each rail 24 forms a track 25. Referring to FIG. 5, the top surface of the track 25 has the same height with the base 21.

Figure 4:
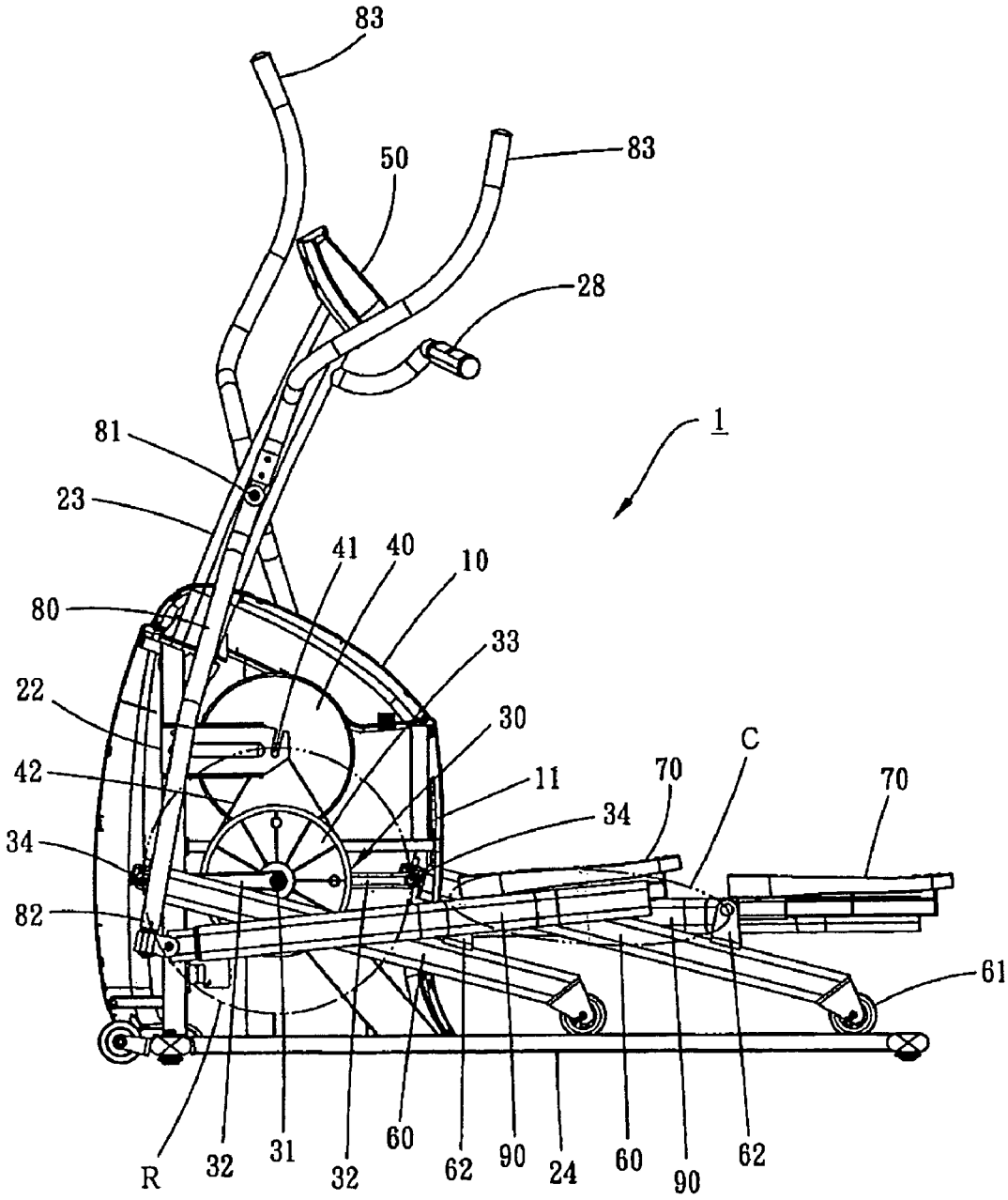
FIG. 4 is a left side view of the preferred embodiment of FIG. 1 without the left half shroud, and two pedals respectively are at a front end and a rear end within a movement area.

Referring to FIG. 2, the frame support 22 includes a rotating assembly 30 which has a crank pivot 31, two crank arms 32 and a large pulley 33. The crank pivot 31 pivots to the frame support 22. The crank arms 32 are secured respectively and symmetrically to the opposite ends of the crank pivot 31, and there is an angular difference of 180 degrees between the two crank arms 32. The outer ends of the crank arms 32 form two pivotal ends 34. As shown in FIG. 4, each pivotal end 34 moves along a circular path R. Now referring to FIG. 5, the bottom of the circular path R is very close to the base 21. In other words, the outer end of the crank arm 32 is very close to the track 25 when the crank arm 32 rotates to a position perpendicular to the ground. More specifically, the distance between the outer end of the crank arm 32 and the track 25 is less than 10 cm when the crank arm 32 is perpendicular to the track 24. The large pulley 33 locates between the two crank arms and coaxially pivots to the crank pivot 31.

Referring to FIG. 4, the rotating assembly 30 further has a flywheel 40 mounted pivotally on the frame support 22. The diameter of the flywheel 40 is smaller than the diameter of the circular path R, and the rear edge of the flywheel 40 is in front of the rear edge of the circular path R. In other words, the flywheel 40 is located on the motion boundary of the crank arm 32. A small pulley 41 is mounted on a left side of the flywheel 40 and positioned over the large pulley 33 of the rotating assembly 30. The flywheel 40 and the small pulley 41 are coaxial. A belt 42 connects the small pulley 41 and the large pulley 33, so that the flywheel 40 and the rotating assembly 30 can rotate simultaneously in a predetermined rotational speed ratio.

In addition, elliptical exercise apparatus 1 generally comprises an eddy-current brake (not shown) located near the flywheel 40. The eddy-current brake comprises a movable magnetic assembly, and a user can use the console 50 to adjust a distance between the flywheel 40 and the movable magnetic assembly for adjusting a rotating resistance of the flywheel 40.

Now referring to FIGS. 1 and 4, a shroud 10 is mounted around the frame support 22. The shroud 10 wraps the rotating assembly 30, the flywheel 40, the eddy-current brake, and the circuits for protecting the mechanism and the user. The front and rear portions of the shroud 10, as shown in FIG. 4, are very close to the front edge and the rear edge of the circular path R, and the rear portion has two parallel slots 11.

As illustrated in FIGS. 1 and 2, each of the left and right supporting rods 60 has a front end pivotally connected to the corresponding pivotal end 34 of the crank arm 32, a middle portion passing through the slot 11 of the shroud 10, and a rear end provided with a respective roller 61 which moves back and forth on the corresponding longitudinal track 25. When the front ends of the left and right supporting rods 60 move along the circular path R, the rear ends move correspondingly along the track 25 between a front point 26 and a rear point 27. Due to the angular difference of 180 degrees between the front ends of the supporting rods 60, the rear ends of the supporting rods move in an opposite direction.

Figure 6:
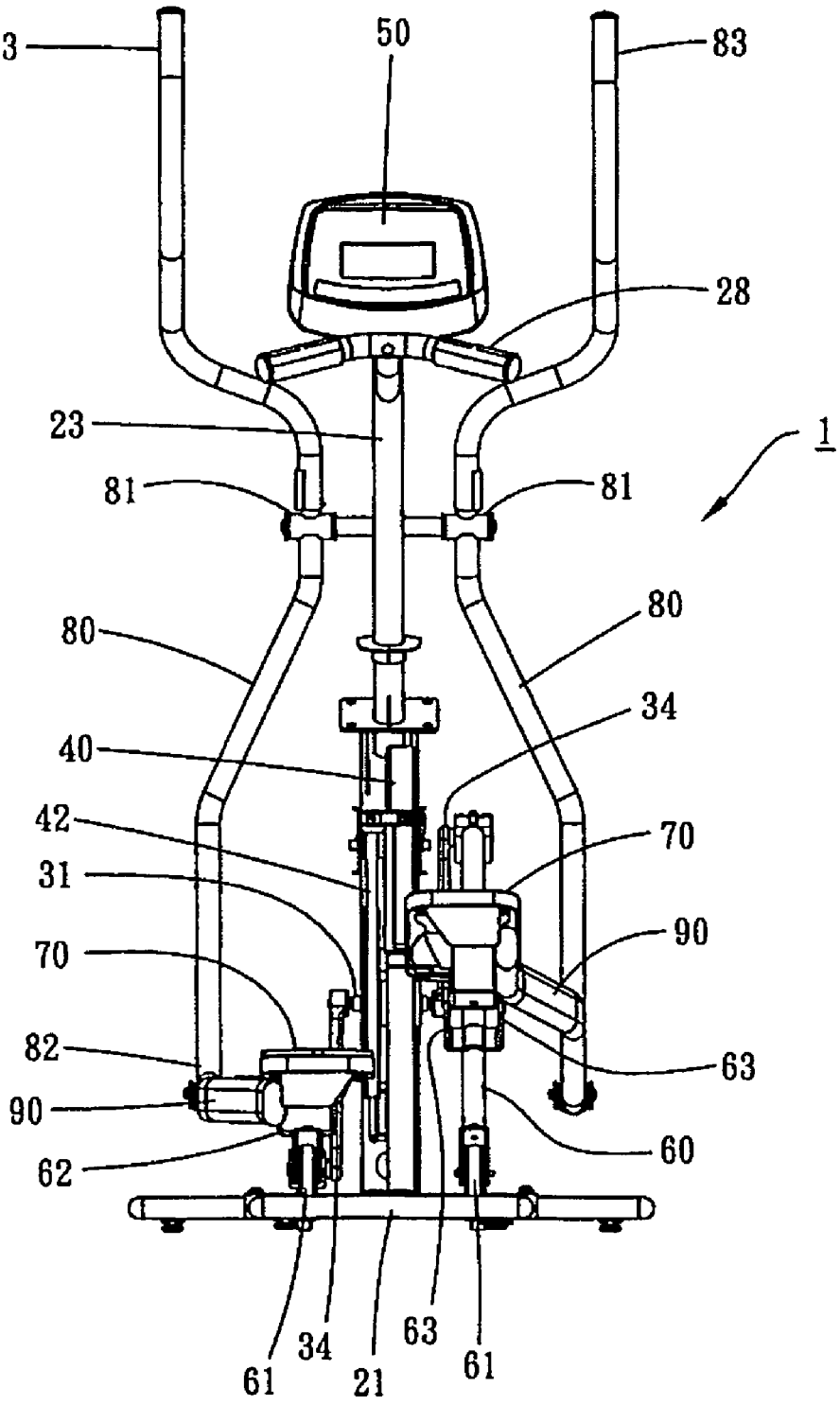
FIG. 6 is a front view of the preferred embodiment of FIG. 5.

As shown in FIG. 4, the distance between the front end and rear end of the supporting rod 60 is greater than the diameter of the circular path R and smaller than two times the diameter of the circular path R. Each supporting rod 60 includes a supporting member 62 locating between the rear end and the middle of the supporting rod 60. Referring to FIG. 6, each supporting member 62 has two opposite fixed plates 63. As aforementioned, the front ends of the left and right supporting rods 60 are restricted to the circular motion and rear ends thereof are restricted to the back and forth motion, so each of the supporting members 62 moves along a substantial elliptical closed path C as depicted in FIG. 4. The long axis of the elliptical closed path C substantially corresponds to the longitudinal axis of the elliptical exercise apparatus, and the short axis of the elliptical closed path C substantially corresponds to the vertical axis of the elliptical exercise apparatus. The front end of the closed path C is very close to the rear end of the circular path R. Specifically, the horizontal distance between the closed path C and the circular path R is less than 20 cm, and the supporting member 62 is very close to the rear portion of the shroud 10 when it moves to the front end of the range of the motion.

As depicted in FIG. 2, left and right swing arms 80 are respectively coupled to the left and right sides of the frame 20 and extend substantially longitudinally. Each of the left and right swing arms 80 includes a pivot point 81 formed at the middle section, a swing end 82 formed at the bottom end for swinging back and forth, and a handle 83 formed at the top end for a user to grip. The swing arms 80 are rotatably connected to the console mast 23 of the frame 20 through their respective pivot points 81.

Each of the swing ends 82 of the left and right swing arms 80 is connected to a link 90. Each of the left and right links 90 has a front end connected pivotally to the swing end 82 for restricting to move along an arcuate path, and a rear portion connected to the corresponding supporting rod 60 via the supporting member 62. So that the supporting rod 60 and the swing arms 80 are driven by each other via the link 90. When the link 90 moves, the angle between the link 90 and the supporting rod 60 will vary with the angle between the pedal 70 and the supporting rod 60.

Left and right pedals 70 for a user to stand on are respectively coupled to the rear portions of the left and right links 90. Each of the left and right pedal 70 has a front end corresponding to the user's toes and a rear end corresponding to the user's heel. In detail, each of the left and right pedal 70 is also pivotally mounted between the fixed plates 63 of the supporting member 62 of the supporting rod 60, so that the front end of each pedal 70 moves along the closed path C, and the pedal 70 moves relative to the supporting rod 60.

During the use of the elliptical exercise apparatus 1, the user stands on the left and right pedals 70 and grips the left and right handles 83. The user imparts force to the pedals 70 and the handles 83, thereby causing the motions of the supporting rods 60, the rotating assembly 30, the links 90, and the swing arms 80, so that the pedals 70 travel along a substantial elliptical path. Left and right handles 83 move respectively along an arcuate path in the opposite directions. In the same way, when one pedal 70 moves forward, the other pedal 70 moves rearward. And each handle 83 moves forward as its respective pedal 70 moves rearward, and vice versa. The user has an option to grip the handlebar 28 at the top of the console mast 23 to exercise his lower body only.

A user can adjust the resistance of the pedals 70 and the handles 83 by adjusting the resistance of the flywheel 40 via the console 50 described above.

During the operation period, while the pedal 70 moves along a downward and backward segment, as the left pedal 70 shown in FIG. 5 or the right pedal 70 shown in FIG. 4, the upper surface of the pedal is substantially horizontal. When the pedal 70 moves along the other segments of the motion path, the front end of the top of the pedal 70 will lower than the rear end of the top of the pedal 70, and it is apparent when the pedal 70 is at the top of the motion path. The angular variation of the pedal conforms to the angular variation of the sole of a person's foot. Therefore a user feels comfortable and his legs may not ache or hurt easily while using the elliptical exercise apparatus 1 according to this invention.

As most clearly shown in FIGS. 4 and 5, the rear end of each supporting rod 60 is always under the corresponding pedal 70. As described above, the rear end of each supporting rod 60 moves back and forth between a front point 26 and a rear point 27 as shown in FIG. 2. Therefore, the front point 26 is not closer to the front region of the frame 20 than the front edge of the closed path C. The rear point 27 is also not closer to the rear region of the frame than the rear edge of the motion path (not shown) of the rear end of the pedal 70. In other words, in the longitudinal direction, the front point 26 of the track 25 aligns transversely or is in back of the front edge of the closed path C of the front ends of the pedals 70. And the rear point 27 of the track 25 aligns transversely or is in front of the rear edge of the closed path C of the rear ends of the pedals 70.

As shown in FIG. 4, the position of the pivot point 81 is substantially over the center of the circular path R, and the longitudinal positions of the front end of the arcuate path of swing end 82 and the front edge of the circular path R are substantially the same. More specifically, the preferred distance between the front end of the arcuate path and the front edge of the circular path R is less than 10 cm. Therefore, during the use of the elliptical exercise apparatus, neither the bottom ends of the swing arm 80 nor the handles 83 of the swing arms 80 will be in front of the shroud 10.

As the figures and described above, the longitudinal length of the elliptical exercise apparatus 1 is substantial equal to the longitudinal length of the motion range of the crank arm 32 plus the longitudinal length of the motion range of the pedal 70. Compared with conventional elliptical exercise apparatuses, the elliptical exercise apparatus 1 of this invention not only provides an adequate travel of the pedals with ergonomic benefits, but also reduces the occupied space. So to a home user who has a limited indoor space, it is easy to place the elliptical exercise apparatus at the corner or to move it. To distributors or fitness centers, more exercise apparatuses can be displayed in the same area. To the manufacturers, size reducing can increase the stock density and reduce the production cost.

Figure 7:
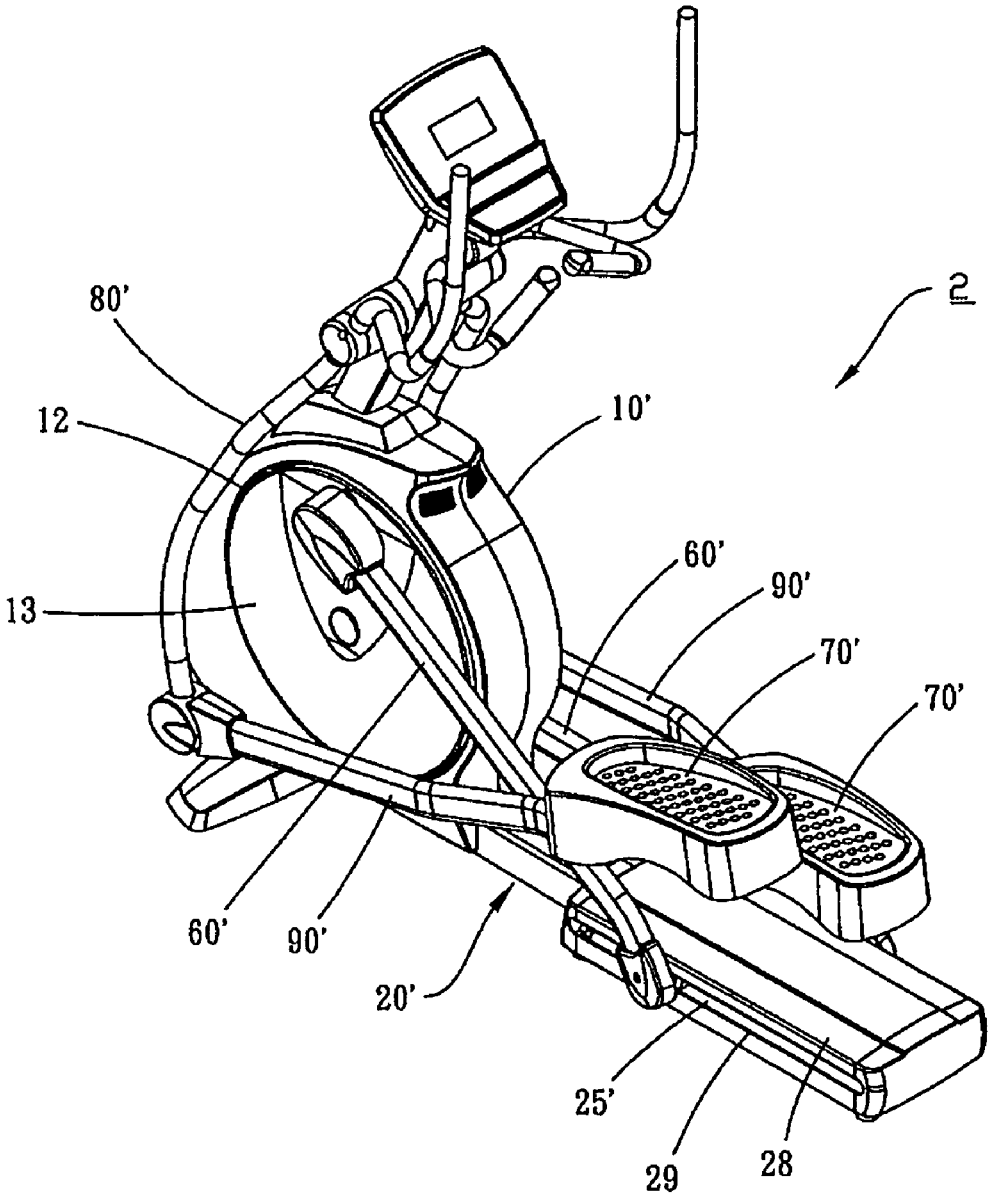
FIG. 7 is a perspective view of another preferred embodiment.
Figure 8:
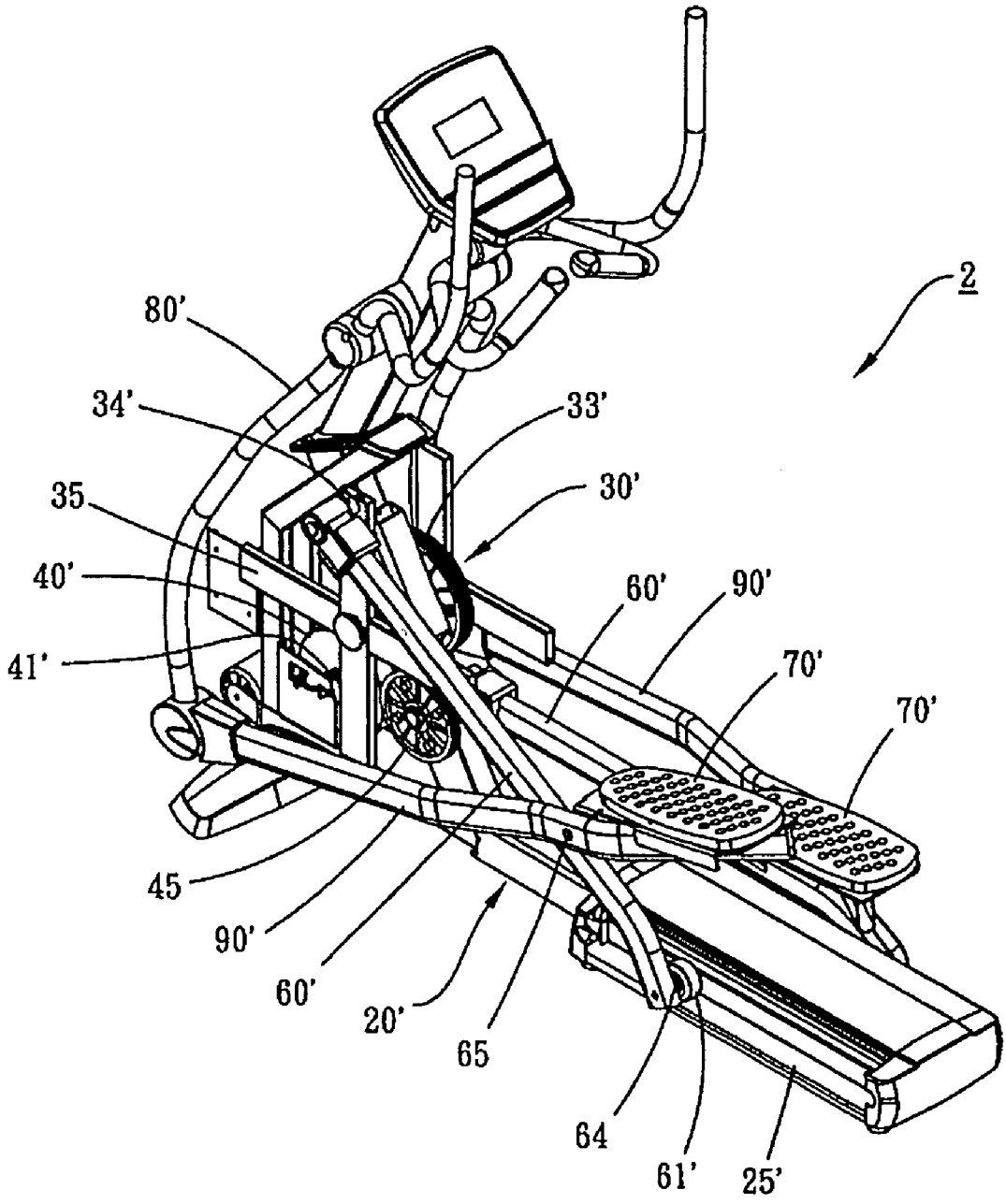
FIG. 8 is a perspective view of the preferred embodiment of FIG. 7 without some parts.
Figure 9:
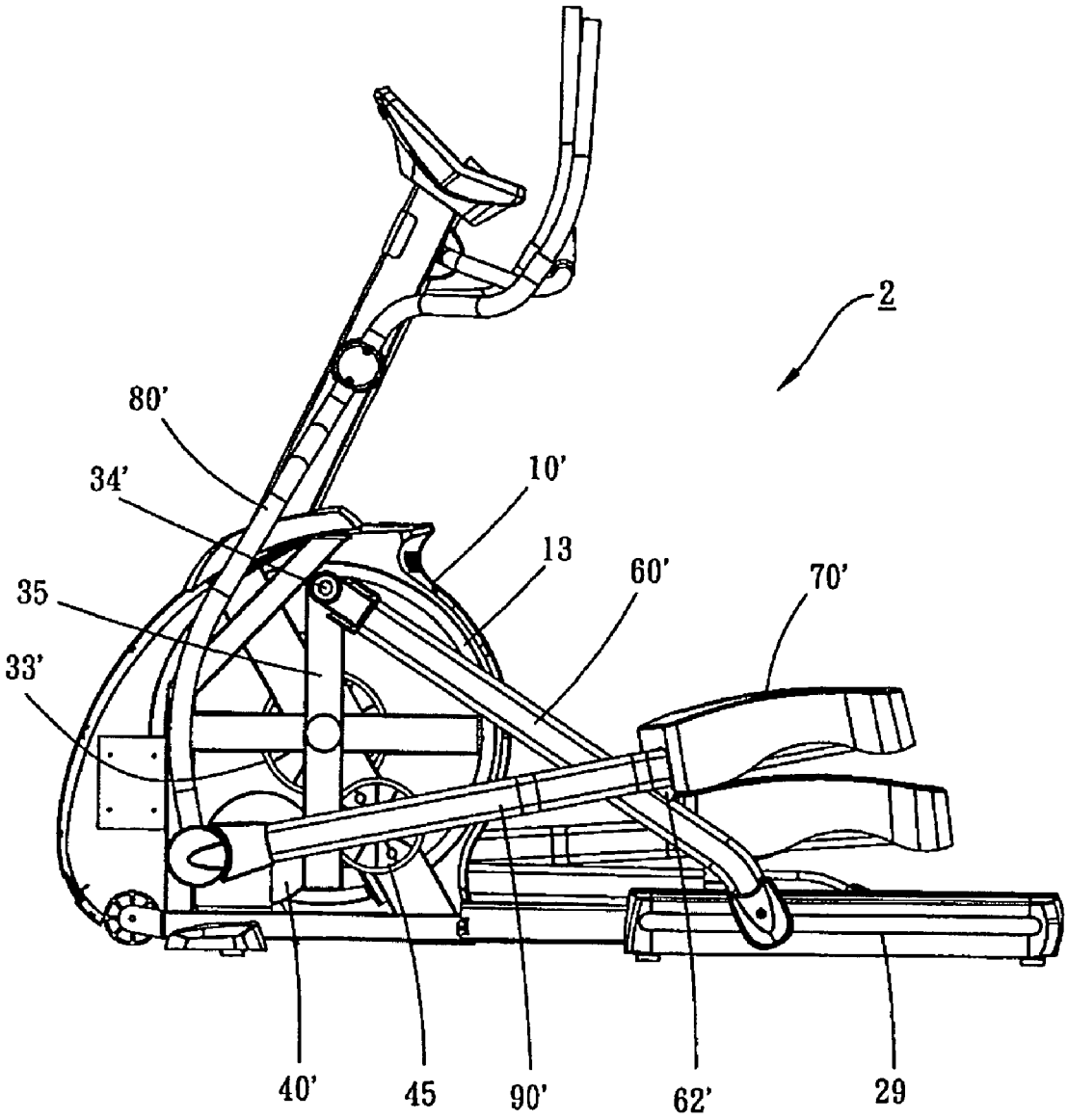
FIG. 9 is a left side view of the preferred embodiment of FIG. 7 without a left half shroud.

Another preferred embodiment according to the present invention is illustrated in FIGS. 7-9. This embodiment also includes the advantages described above, and the members and the relationships therebetween of this embodiment are substantial the same with those of the previous preferred embodiment. The different features will be described below.

As shown in FIGS. 7 to 9, a rotating assembly 30' includes two opposite crank arms 35 which are in the shape of a cross. An outer end of a branch of each crank forms a pivotal end 34'. A shroud 10' wraps the rotating assembly 30' in the front region of the frame 20' and has two round openings 12 corresponding to the left side and a right side of the cranks 35. Two round plates 13 are attached respectively to the crank arms 35 beside the round openings 12. Respectively, the front ends of the supporting rods 60' are connected pivotally to the pivotal end 34' outside the round plates 13. In this embodiment, the width of the shroud 10' is narrower than that in the embodiment described above.

Left and right tracks 25' which extend longitudinally are mounted on the rear end of the base of the frame 20'. The tracks 25' are under a cover 28' and on two opposite sides of the cover 28'. The rear ends of the supporting rods 60' move outside the cover 28'. Two roller pivots 64 each passes through a slot 29 on the side of the cover 28' and has two opposite ends. One end is connected to the rear end of supporting rod 60', and the other end is connected to a corresponding roller 61' within the cover 28'. So the rollers 61' can travel on the tracks 25' and are protected by the cover 28'.

In the embodiment, the flywheel 40' is smaller than that in the previous embodiment, and the position of the flywheel 40' is lower than the rotating assembly 30', so that the shroud 10' is close to the rotating assembly 30'. A medium pulley set 45 is coupled pivotally within the shroud 10' and composed of a large wheel and a small wheel. The large pulley 33' of the rotating assembly 30' connects with the small wheel of the medium pulley set 45 via a belt, and the large wheel of the medium pulley set 45 connects with the small pulley 41' of the flywheel 40' via another belt (not shown), so that the transmission can be completed in a limited space.

In the previous preferred embodiment, the pedals 70 are mounted pivotally respectively on the supporting rods 60 and connected to the links 90, and the links 90 are not connected to the supporting rods 60 directly. In the present embodiment, the front ends of the pedals 70' are also respectively pivotally mounted on the supporting member 62' of the supporting rods 60'. The main difference between the two embodiments is the links 90 are connected respectively to the supporting members 62' through the axis 65. The rear portions of the links 90 respectively curve inward to the bottom of the pedals 70' for fixing thereon, so that the pedals 70' are mounted more stably on the supporting rods 60'.

The other parts in this embodiment, such as the relationships or the distances between the members, and scale of the members are all the same with those in the previous embodiment. The elliptical exercise apparatus 2 provides the complete travel of the pedals with ergonomic benefits and save space, too. Compared with the previous embodiment, the shroud 10' in this embodiment is lower and narrower.

Figure 10:
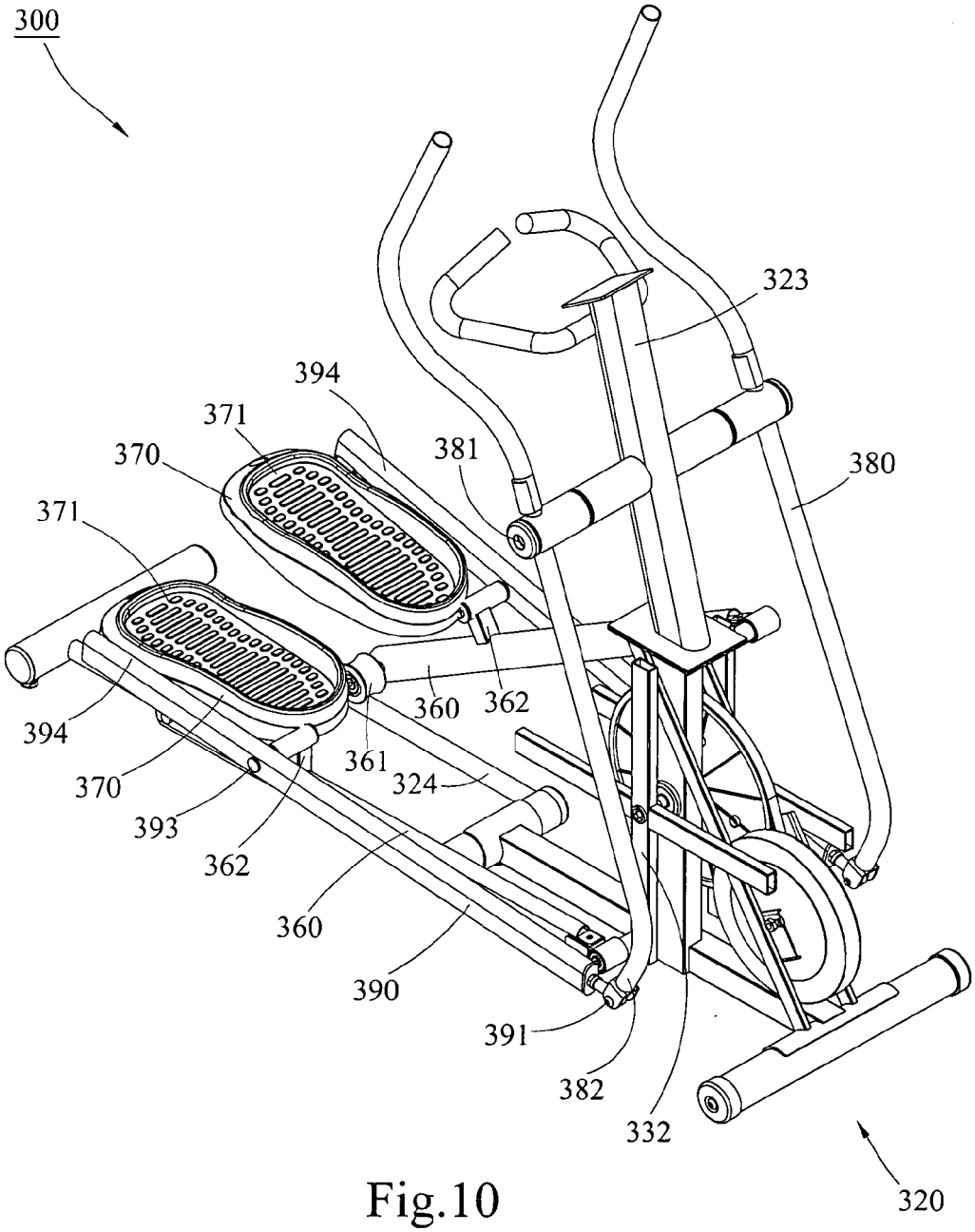
FIG. 10 is a perspective view of another preferred embodiment.
Figure 11:
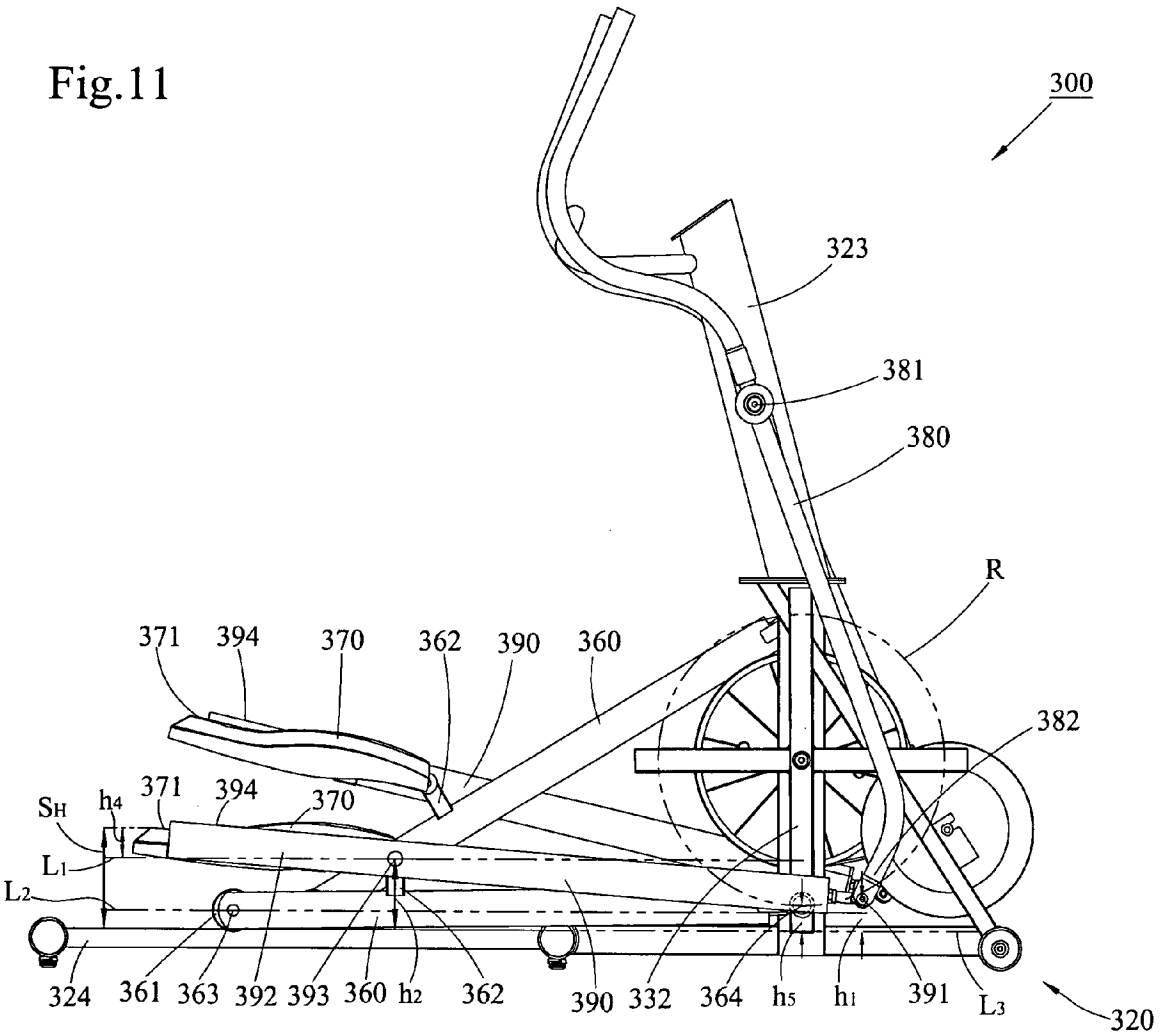
FIG. 11 is a right side view of the preferred embodiment of FIG. 10 without a right half shroud.

FIGS. 10 and 11 illustrate a third embodiment corresponding to the invention. Most structures of the third embodiment are the same with the first embodiment. The elliptical exercise apparatus 300 has a frame 320. There are two tracks 324 mounted on the rear region of the frame 320. There are crank arms 332 pivotally mounted with the frame 320. Each of the left and right supporting rods 360 has a front end connected to a pivotal ends 364 of corresponding crank arms 332 and a rear end mounted with a roller 361 for moving along the corresponding track 324. The elliptical exercise apparatus 300 also comprises left and right swing arms 380 and left and right links 390. Each of the left and right swing arms 380 has a pivot point 381 connected to a console mast 323 and a swing end 382 located below the pivot point 381 for moving back and forth. Each of the left and right links 390 has a rear portion 392 and a front end connected to the corresponding swing end 382 of the swing arm 380 to form a first joint 391. Each of the rear portions 392 of the links 390 is coupled to the corresponding supporting rod 360 to form a second joint 393. Left and right pedals 370 of the third embodiment are coupled to the corresponding left and right links 390 in a way different from the first embodiment. More specifically, each of the left and right rear portions 392 of the left and right links 390 is positioned behind a middle point of each of the left and right links 390. Each of the rear portions 392 has a top surface 394. For example, the left and right links 390 are made of square tubes. Traditionally, left and right pedals are mounted on and above the top surface of the links. As illustrated in FIG. 11, the left and right pedals 370 are substantially positioned alongside and respectively coupled to the rear portions 392 of the left and right links 390. Opposite to the traditional way which directly couples the left and right pedals above the top surface of the links, FIG. 11 depicts that the step surface 371 is lower than the corresponding top surface 394 of the rear portion 392 of the link 390. The step height can therefore be reduced at least 2 or 3 cm by positioning the left and right pedals 370 as disclosed above.

The elliptical exercise apparatus 300 of the third embodiment substantially has the features as mentioned in the first embodiment. Besides, the third embodiment further comprises a low step height feature. Referring to FIG. 11, the elliptical exercise apparatus 300 has the left and right pedals 370 which respectively have step surfaces 371 for pedaling. Generally, the height between the ground and the step surface 371 when the step surface 371 is at its lowest position is called as step height by people skilled in the art. In order to define the step height more specifically, it is defined herein that the step height is the vertical distance between the highest point of the step surface 371 and the top surface of the track 324 when the step surface 371 is at its lowest position. When the step surface 371 is at its lowest position, the pivotal ends 364 of the crank arms 332 are respectively and substantially rotated to the highest and lowest positions of a circular path R which is the trajectory of the pivotal ends 364 of the crank arms 332. Also, the front ends of left and right supporting rods 360 are respectively at the highest and lowest positions. People skilled in the art have tried to optimize the step height for providing a safer and easier access stationary exercise apparatus for a user.

As depicted in FIG. 11, the right crank arm 332 is rotated to a vertical position and a height between the pivotal end 364 of the right crank arm 332 and a third line L3 is defined as fifth height $h_5$. The third line L3 is a reference line horizontally extended from the top surface of the right track 324. In these preferred embodiments, the fifth height $h_5$ is less than 10 cm. In the meantime, the right second joint 393 has a second height $h_2$ relative to the top surface of the track 324. In the third embodiment, the second height $h_2$ is in a range between 10 cm and 20 cm because of positioning left and right supporting members 362 between the supporting rods 360 and the links 390. In theory, the second height $h_2$ could be substantially the same height with the fifth height $h_5$ if the links 390 directly pivoted to the supporting rod 360 by omitting the left and right supporting members 362. Therefore, the second height $h_2$ could possibly be less than 10 cm. The right step surface 371 of the pedal 370 has a step height $S_H$ which is equal to the second height $h_2$ plus a fourth height $h_4$. The fourth height $h_4$ is a vertical distance between the highest point of the step surface 371 and a first line $L_1$. The first line $L_1$ is a reference line horizontally extending through the second joint 393 and parallel to the top surface of the track 324. Also, the first joint 391 has a first height $h_1$ relative to the third line $L_3$. In the third embodiment, the fourth height $h_4$ is determined by two parameters. One is the position and way that the right pedal 370 is coupled to the rear portion 392 of the right link 390. The other parameter is the first height $h_1$. As depicted in FIG. 11, in order to provide better ergonomics for a user, the first height $h_1$ is slightly smaller than the second height $h_2$. Therefore, the right link 390 is at a forward decline posture for a user to thrust the right pedal backward easier. This decline posture could result in some increment of the fourth height $h_4$. Theoretically, in order to reduce the fourth height $h_4$ for decreasing the step height $S_H$ without changing the first height h1, length of the links 390 and location of the pedals 370 should be limited. In this invention, the length of the supporting rod 360 is limited between the diameter of the circular path R and twice the diameter thereof. Besides, each of the left and right pedals 370 is always over the corresponding rear end of the supporting rod 360 or the front ends of the pedals 370 are respectively aligned with the second joints 393. Similar to the first embodiment, the distance between the front edge of the closed path and the rear edge of the circular path R is smaller than 20 cm. Comparing to FIG. 5, the step surface 371 of FIG. 11 is significantly lower by coupling the pedal 370 alongside the rear portion 392 of the link 390. These limitations result in the smaller fourth height $h_4$.

In the third embodiment, the first height $h_1$ is smaller than the second height $h_2$. However, this does not exclude that the first height $h_1$ is substantially equal to the second height $h_2$. In this situation, the link 390 should be substantially parallel to the top surface of the track 324. The fourth height $h_4$ could be further reduced. Please also refer to FIG. 5, the left pedal 70 of the first embodiment is at the lowest position of the closed path C and the left link 90 is substantially parallel to the track 24. As aforementioned, the first height $h_1$ is limited by the second height $h_2$. Therefore, a small second height $h_2$ is preferred in the current invention. In the third embodiment, the left and right links 390 are connected to the respective left and right supporting rods 360 by left and right supporting members 362. The position where the supporting member 362 is located on the supporting rod 360 controls ergonomics, such as the shape of the pedal closed path. In the elliptical exercise apparatus 300, each of the left and right supporting members 362 is mounted on the corresponding supporting rod 360 at a position which is located behind the middle point of the supporting rod 360 and ahead the rear end thereof. Also, each of the left and right supporting members 362 is coupled to the corresponding left and right links 390 via the second joint 393 which is spaced apart from the supporting rods 360 and located near the rear portion 392 of the link 390. Further advantage of the supporting members 362 is to prevent scissors phenomena between the supporting rods 360 and rear portions 392 of the links 390. Because of the supporting member 362, there would respectively be some gaps between the supporting rods 360 and rear portions 392 of the links 390. People skilled in the art may directly pivot the link 390 to the supporting rod 360 without supporting member 362 for further reducing the second height $h_2$. This should be also under the scope of the current invention. As mentioned above, the limitations of the first height $h_1$, the second height $h_2$, and the fifth height $h_5$ directly result in a low step height $S_H$ of the stationary exercise apparatus 300.

The present invention does not require that all the advantageous features and all the advantages need to be incorporated into every embodiment thereof. Although the present invention has been described in considerable detail with reference to certain preferred embodiment thereof, other embodiments are possible.

What is claimed is:

1. A stationary exercise apparatus, comprising:

(a) a frame adapted to rest on a surface, the frame having a rear region which has a track extending longitudinally;

(b) a crank arm rotatably connected to the frame and having a pivotal end rotating along a circular path, wherein the height between the track and the bottom of the circular path is shorter than 10 cm;

(c) a supporting rod having a front end connected to the pivotal end of the crank arm, a rear end moving along the track of the frame, and a middle point, the length of the supporting rod being between the diameter of the circular path and twice the diameter thereof, wherein the front end and the rear end of the supporting rod are substantially at the same height when the front end of the supporting rod is at the lowest position of the circular path;

(d) a swing arm having a pivot point connected to the frame and a swing end located below the pivot point for moving back and forth;

(e) a link having a front end connected to the swing end of the swing arm to form a first joint, and having a rear portion connected to the supporting rod to form a second joint wherein a second height from the second joint to the track is in a range between 10 cm and 20 cm and a first height from the first joint to the track is smaller than the second height when the front end of the supporting rod is at the lowest position of the circular path; and (f) a pedal alongside coupled to the rear portion of the link and being over the rear end of the supporting rod, the pedal having a step surface which is lower than the top surface of the rear portion of the link.

2. The stationary exercise apparatus of claim 1, the supporting rod further comprising a supporting member interconnected the link and the supporting rod, the supporting member connected to the supporting rod at a position which is located between the middle point and the rear end of the supporting rod, and the supporting member connected to the link at a position which is located between the middle point and the rear end of the link.

3. The stationary exercise apparatus of claim 1, wherein a step height between a highest point of the step surface of the pedal and the track is in a rage of 10 cm and 20 cm.

4. A stationary exercise apparatus, comprising:

(a) a frame adapted to rest on a surface and having a track extending longitudinally;

(b) a crank arm rotatably connected to the frame and having a pivotal end rotating along a circular path, wherein the height between the track and the bottom of the circular path is less than 10 cm;

(c) a supporting rod having a front end connected to the pivotal end of the crank arm, a rear end moving along the track of the frame, and a middle point, the length of the supporting rod being between the diameter of the circular path and twice the diameter thereof;

(d) a swing arm having a pivot point connected to the frame and a swing end located below the pivot point for moving back and forth;

(e) a link having a front end connected to the swing end of the swing arm to form a first joint, and having a rear portion coupled to the supporting rod to form a second joint wherein a second height from the second joint to the track is less than 20 cm and a first height from the first joint to the track is smaller than the second height when the front end of the supporting rod is at the lowest position of the circular path; and (f) a pedal coupled to the rear portion of the link and being over the rear end of the supporting rod wherein the highest point of the step surface of the pedal has a step height relative to the track and the step height is less than 20 cm.

5. The stationary exercise apparatus of claim 4, wherein the second height is in a rage of 10 cm and 20 cm.

6. The stationary exercise apparatus of claim 5, wherein the pedal is alongside coupled to the rear portion of the link.

7. The stationary exercise apparatus of claim 6, wherein the step height is in a rage of 10 cm and 20 cm.

* * * * *